US011927098B2

(12) United States Patent
Chen et al.

(10) Patent No.: US 11,927,098 B2
(45) Date of Patent: Mar. 12, 2024

(54) METHOD AND APPARATUS FOR CONTROLLING STRATUM DEFORMATION IN SHIELD CONSTRUCTION PROCESS, AND NON-VOLATILE STORAGE MEDIUM

(71) Applicants: CHINA RAILWAY 14TH BUREAU GROUP CO., LTD., Shandong (CN); CHINA RAILWAY SIYUAN SURVEY AND DESIGN GROUP CO., LTD., Hubei (CN)

(72) Inventors: Jian Chen, Shandong (CN); Mingqing Xiao, Shandong (CN); Chengzhen Wang, Shandong (CN); Xiuting Su, Shandong (CN); Shuchen Li, Shandong (CN); Feng Xue, Shandong (CN); Xiudong Li, Shandong (CN); Yankun Wu, Shandong (CN); Wenhao Sun, Shandong (CN)

(73) Assignees: CHINA RAILWAY 14TH BUREAU GROUP CO., LTD., Shangdong (CN); CHINA RAILWAY SIYUAN SURVEY AND DESIGN GROUP CO., LTD., Hubei (CN)

( * ) Notice: Subject to any disclaimer, the term of this patent is extended or adjusted under 35 U.S.C. 154(b) by 114 days.

(21) Appl. No.: 17/431,725

(22) PCT Filed: May 7, 2020

(86) PCT No.: PCT/CN2020/088938

§ 371 (c)(1),
(2) Date: Aug. 18, 2021

(87) PCT Pub. No.: WO2021/184507

PCT Pub. Date: Sep. 23, 2021

(65) Prior Publication Data

US 2022/0397036 A1 Dec. 15, 2022

(30) Foreign Application Priority Data

Mar. 20, 2019 (CN) ..... 202010203051.X

(51) Int. Cl.
*E21D 9/06* (2006.01)
*E21D 9/093* (2006.01)

(52) U.S. Cl.
CPC ..... *E21D 9/0607* (2013.01); *E21D 9/093* (2016.01)

(58) Field of Classification Search
CPC ..... E21D 9/06; E21D 9/0607; E21D 9/093
See application file for complete search history.

(56) References Cited

FOREIGN PATENT DOCUMENTS

CN 2007284903 A 11/2007
CN 102071944 A 5/2011
(Continued)

*Primary Examiner* — Frederick L Lagman
(74) *Attorney, Agent, or Firm* — Samson G. Yu

(57) ABSTRACT

A method and apparatus for controlling stratum deformation in a shield construction process, a non-volatile storage medium, and a processor are disclosed. The method includes: monitoring settlement characteristic parameters in a shield construction process; predicting a settlement proportion according to the settlement characteristic parameters, the settlement proportion being a ratio between a predicted settlement value and a corresponding settlement threshold; and determining construction parameters in the shield construction process according to the settlement proportion. In the method, a settlement proportion is predicted through settlement characteristic parameters monitored in a shield construction process, and then appropriate construction parameters are determined according to the settlement proportion, so that the construction parameters in the shield construction process can be corrected in real time, and the safety and scientificity of stratum deformation control in shield construction can be ensured.

13 Claims, 4 Drawing Sheets

(56) References Cited

FOREIGN PATENT DOCUMENTS

| | | | | | |
|---|---|---|---|---|---|
| CN | 102493424 | A | | 6/2012 | |
| CN | 103195435 | A | | 7/2013 | |
| CN | 105804761 | A | | 7/2016 | |
| CN | 107489424 | A | | 12/2017 | |
| CN | 107515976 | A | | 12/2017 | |
| CN | 108590683 | A | | 9/2018 | |
| CN | 109763828 | A | | 5/2019 | |
| CN | 110185463 | A | | 8/2019 | |
| CN | 112523767 | A | * | 3/2021 | |
| CN | 113123361 | A | * | 7/2021 | ..... E02D 19/04 |
| JP | 2007028493 | A | | 2/2007 | |

* cited by examiner

METHOD AND APPARATUS FOR CONTROLLING STRATUM DEFORMATION IN SHIELD CONSTRUCTION PROCESS, AND NON-VOLATILE STORAGE MEDIUM

CROSS-REFERENCE TO RELATED APPLICATION

The disclosure claims priority to Application No. 202010203051.X, filed on Mar. 20, 2020 and entitled "Method and Apparatus for Controlling Stratum Deformation in Shield Construction Process, and Storage Medium", the entire contents of which are incorporated herein by reference.

TECHNICAL FIELD

The disclosure relates to the technical field of shield tunnel engineering, in particular to a method and apparatus for controlling stratum deformation in a shield construction process, a non-volatile storage medium, and a processor.

BACKGROUND

Since a shield technology has the advantages of high mechanization, high construction speed, environmental friendliness, construction safety, etc., the shield technology is widely applied to urban tunnel construction. However, shield tunnel construction conditions are complex, and it is difficult to avoid stratum disturbance in the construction process, resulting in soil deformation, surface uplift or settlement, and influence on the surface and surrounding environmental safety.

To solve this problem, scholars at home and abroad have done a lot of research. Some scholars use a three-dimensional numerical simulation method to determine a synchronous grouting amount, set an appropriate slurry pressure value, and control an advance speed to control stratum settlement. Some scholars also propose surface settlement control measures from five aspects of underground water loss, soil bin pressure, synchronous grouting, grout performance, and surrounding rock self-stability, and there are also disclosure patents of making corresponding settlement control values according to settlement development characteristics of different stages. The research and the disclosure can effectively alleviate the surface settlement problem caused by shield construction to a certain extent, but since the development characteristics of stratum settlement are different, the main factors influencing the settlement are also different, and corresponding control measures need to be made for different settlement processes.

An effective solution has not been proposed yet currently for the foregoing problem.

SUMMARY

According to an aspect of the embodiments of the disclosure, a method for controlling stratum deformation in a shield construction process is provided. The method includes the following steps: settlement characteristic parameters in a shield construction process are monitored; a settlement proportion is predicted according to the settlement characteristic parameters, the settlement proportion being a ratio between a predicted settlement value and a corresponding settlement threshold; and construction parameters in the shield construction process are determined according to the settlement proportion.

Optionally, the stratum deformation process in the shield construction process is divided into five settlement stages, namely a pre-deformation stage, an excavation face deformation stage, a deformation stage in passing process, a shield tail rear deformation stage, and a post-deformation stage. The operation that construction parameters in the shield construction process are determined according to the settlement proportion includes: the construction parameters corresponding to the settlement stages are determined according to a settlement proportion of each settlement stage.

Optionally, the operation that a settlement proportion is predicted according to the settlement characteristic parameters includes: machine training is performed by using multiple training data sets to obtain a settlement prediction model, each training data set including: training settlement characteristic parameters and a training settlement proportion corresponding to each training settlement stage; and the settlement characteristic parameters corresponding to each settlement stage are analyzed by adopting the settlement prediction model, and the settlement proportion corresponding to each settlement stage is predicted.

Optionally, the settlement characteristic parameters corresponding to the pre-deformation stage include a tunnel burial depth, a section size, an underground pore water pressure, and a supporting force, the settlement characteristic parameters corresponding to the excavation face deformation stage include a tunnel burial depth, a section size, an underground water pressure, and a supporting force, the settlement characteristic parameters corresponding to the deformation stage in passing process include a tunnel burial depth, a section size, an underground pore water pressure, and a filling amount of inert filling materials, the settlement characteristic parameters corresponding to the shield tail rear deformation stage include a tunnel burial depth, a section size, an underground water pressure, a elastic modulus of synchronous post-grouting slurry, and a grouting pressure, and the settlement characteristic parameters corresponding to the post-deformation stage include a tunnel burial depth, a section size, an underground water pressure, and mechanical parameters of stratum.

Optionally, the operation that the construction parameters corresponding to the settlement stages are determined according to a settlement proportion of each settlement stage includes: it is determined whether the settlement proportion of each settlement stage is within a corresponding predetermined range; and the construction parameters corresponding to target settlement stage are adjusted when the settlement proportion of the target settlement stage is not within the corresponding predetermined range.

Optionally, the construction parameters corresponding to the pre-deformation stage and the excavation face deformation stage include a slurry pressure, the settlement proportion corresponding to the pre-deformation stage is a first settlement proportion, the settlement proportion corresponding to the excavation face deformation stage is a second settlement proportion, the predetermined ranges corresponding to the pre-deformation stage and the excavation face deformation stage are a first predetermined range, a minimum value of the first predetermined range is a first threshold, and a maximum value of the first predetermined range is a second threshold. The operation that the construction parameters corresponding to targe settlement stage are adjusted when the settlement proportion of the target settlement stage is not within the corresponding predetermined range includes: the slurry pressure is reduced when the first settlement proportion and/or the second settlement proportion are smaller than the first threshold; and the slurry pressure is increased when the first settlement proportion and/or the second settlement proportion are greater than the second threshold.

Optionally, the slurry pressure ranges from $P_w$ to $P_w$+20 kpa, where $P_w$ is a hydrostatic pressure at the location of the pre-deformation stage or the excavation face deformation stage.

Optionally, the construction parameters corresponding to the deformation stage in passing process include at least one of a fluctuation value of a incision water pressure, a tunneling speed, a cutter head torque, a cutter head rotating speed, and a filling material injection rate, the settlement proportion corresponding to the deformation stage in passing process is a third settlement proportion, the predetermined range corresponding to the deformation stage in passing process is a second predetermined range, a minimum value of the second predetermined range is a third threshold, and a maximum value of the second predetermined range is a fourth threshold. The operation that the construction parameters corresponding to the settlement stage are adjusted when target settlement proportion of the target settlement stage is not within the corresponding predetermined range includes: at least one of the fluctuation value of the incision water pressure, the tunneling speed, the cutter head torque, and the cutter head rotating speed is increased, and/or the filling material injection rate is reduced when the third settlement proportion is smaller than the third threshold; and at least one of the fluctuation value of the incision water pressure, the tunneling speed, the cutter head torque, and the cutter head rotating speed is reduced, and/or the filling material injection rate is increased when the third settlement proportion is greater than the fourth threshold.

Optionally, the fluctuation value of the incision water pressure ranges from 0 to 10 kpa, the tunneling speed ranges from 15 to 30 mm/min, the cutter head torque ranges from 6 to 9 MNm, the cutter head rotating speed ranges from 0.8 to 1.2 rpm, and the filling material injection rate ranges from 120% to 130%.

Optionally, the construction parameters corresponding to the shield tail rear deformation stage include a grouting pressure and/or a grouting amount, the settlement proportion corresponding to the shield tail rear deformation stage is a fourth settlement proportion, the predetermined range corresponding to the shield tail rear deformation stage is a third predetermined range, a minimum value of the third predetermined range is a fifth threshold, and a maximum value of the third predetermined range is a sixth threshold. The operation that the construction parameters corresponding to target settlement stage are adjusted when the settlement proportion of the target settlement stage is not within the corresponding predetermined range includes: the grouting pressure and/or the grouting amount are reduced when the fourth settlement proportion is smaller than the fifth threshold; and the grouting pressure and/or the grouting amount are increased when the fourth settlement proportion is greater than the sixth threshold.

Optionally, the grouting pressure ranges from Ps+0.85 Ff to Ps+1.25 Ff, and the grouting amount is greater than or equal to 1.3 Vs, where Ps is a predetermined grouting pressure, Ff is a pipeline friction force, and Vs is a predetermined grouting amount.

Optionally, the construction parameters corresponding to the post-deformation stage include a secondary grouting pressure, the settlement proportion corresponding to the post-deformation stage is a fifth settlement proportion, the predetermined range corresponding to the post-deformation stage is a fourth predetermined range, a minimum value of the fourth predetermined range is a seventh threshold, and a maximum value of the predetermined range is an eighth threshold. The operation that the construction parameters corresponding to targe settlement stage are adjusted when the settlement proportion of the target settlement stage is not within the corresponding predetermined range includes: the secondary grouting pressure is reduced when the fifth settlement proportion is smaller than the seventh threshold; and the secondary grouting pressure is increased when the fifth settlement proportion is greater than the eighth threshold.

Optionally, the secondary grouting pressure ranges from 400 to 600 kpa.

According to another aspect of the embodiments of the disclosure, an apparatus for controlling stratum deformation in a shield construction process is provided. The apparatus includes: a monitoring unit, configured to monitor settlement characteristic parameters of stratum deformation in a shield construction process; a prediction unit, configured to predict a settlement proportion according to the settlement characteristic parameters, the settlement proportion being a ratio between a predicted settlement value and a corresponding settlement threshold; and a determination unit, configured to determine construction parameters in the shield construction process according to the settlement proportion.

According to another aspect of the embodiments of the disclosure, a non-volatile storage medium is provided. The non-volatile storage medium includes a stored program, where when the program is run, a device where the non-volatile storage medium is located is controlled to perform any one of the control methods.

According to yet another aspect of the embodiments of the disclosure, a processor is provided. The processor is configured to run a program, where the program, when run, performs any one of the control methods.

In the embodiments of the disclosure, in the above method, firstly, settlement characteristic parameters in a shield construction process are monitored; then a settlement proportion is predicted according to the settlement characteristic parameters, namely a ratio of a predicted settlement value to a corresponding settlement threshold, where the settlement value is a distance of stratum deformation settlement in the shield construction process, and the settlement threshold is a maximum settlement value for ensuring soil stability; and finally, construction parameters in the shield construction process are determined according to the settlement proportion. In the method, a settlement proportion is predicted through settlement characteristic parameters monitored in a shield construction process, and then appropriate construction parameters are determined according to the settlement proportion, so that the construction parameters in the shield construction process can be corrected in real time, the safety and scientificity of stratum deformation control in shield construction can be ensured, and the problem in the existing technology that it is difficult to control stratum deformation settlement can be solved.

Figure 1:
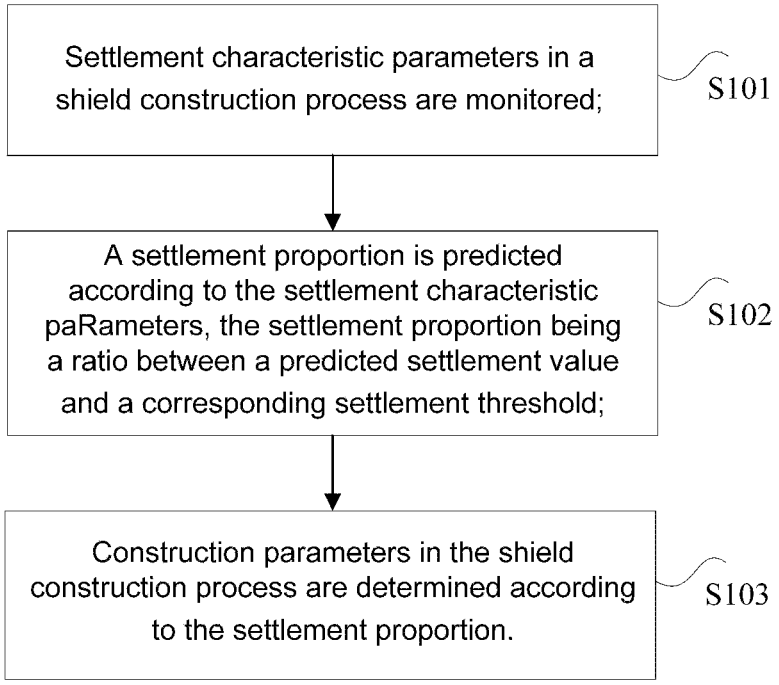
FIG. 1 is a flowchart of a method for controlling stratum deformation in a shield construction process according to an embodiment of the disclosure.

The drawings include the following reference signs:

01, filling material; 02, shield tail clearance; 03, newly injected grout; 04, strengthened grout; 05, lining; 10, shield machine; 11, shield body; 111, radial grouting hole; 12, cutter head; 13, shield tail sealing structure.

DETAILED DESCRIPTION OF THE EMBODIMENTS

In order to make those skilled in the art better understand the solutions of the disclosure, the technical solutions in the embodiments of the disclosure will be clearly and completely described below with reference to the drawings in the embodiments of the disclosure. It is apparent that the described embodiments are only a part of the embodiments of the disclosure, not all of the embodiments. On the basis of the embodiments of the disclosure, all other embodiments obtained on the premise of no creative work of those of ordinary skill in the art should fall within the scope of protection of the disclosure.

It is to be noted that the specification and claims of the disclosure and the terms "first", "second" and the like in the drawings are used to distinguish similar objects, and do not need to describe a specific sequence or a precedence order. It will be appreciated that data used in such a way may be exchanged under appropriate conditions, in order that the embodiments of the disclosure described here can be implemented in a sequence other than sequences graphically shown or described here. In addition, terms "include" and "have" and any variations thereof are intended to cover non-exclusive inclusions. For example, it is not limited for processes, methods, systems, products or equipment containing a series of steps or units to clearly list those steps or units, and other steps or units which are not clearly listed or are inherent to these processes, methods, products or equipment may be included instead.

According to the embodiments of the disclosure, a method for controlling stratum deformation in a shield construction process is provided. It is to be noted that the steps shown in the flowchart of the drawings may be executed in a computer system including, for example, a set of computer-executable instructions. Moreover, although a logic sequence is shown in the flowchart, the shown or described steps may be executed in a sequence different from the sequence here under certain conditions.

FIG. 1 is a flowchart of a method for controlling stratum deformation in a shield construction process according to an embodiment of the disclosure. As shown in FIG. 1, the method includes the following steps.

At step S101, settlement characteristic parameters in a shield construction process are monitored.

At step S102, a settlement proportion is predicted according to the settlement characteristic parameters, the settlement proportion being a ratio between a predicted settlement value and a corresponding settlement threshold.

At step S103, construction parameters in the shield construction process are determined according to the settlement proportion.

In the above method, firstly, settlement characteristic parameters in a shield construction process are monitored; then a settlement proportion is predicted according to the settlement characteristic parameters, namely a ratio of a predicted settlement value to a corresponding settlement threshold, where the settlement value is a distance of stratum deformation settlement in the shield construction process, and the settlement threshold is a maximum settlement value for ensuring soil stability; and finally, construction parameters in the shield construction process are determined according to the settlement proportion. In the method, a settlement proportion is predicted through settlement characteristic parameters monitored in a shield construction process, and then appropriate construction parameters are determined according to the settlement proportion, so that the construction parameters in the shield construction process can be corrected in real time, the safety and scientificity of stratum deformation control in shield construction can be ensured, and the problem in the existing technology that it is difficult to control stratum deformation settlement can be solved.

Figure 2:
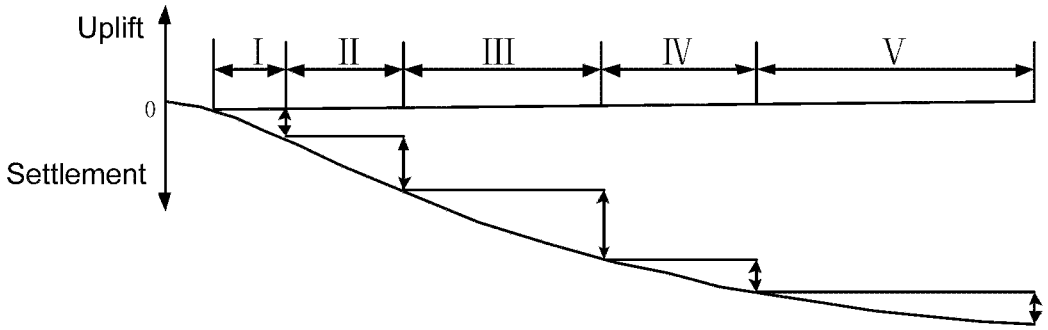
FIG. 2 is a schematic diagram of a whole process curve of stratum settlement of a characteristic section at a certain time according to an embodiment of the disclosure.
Figure 3:
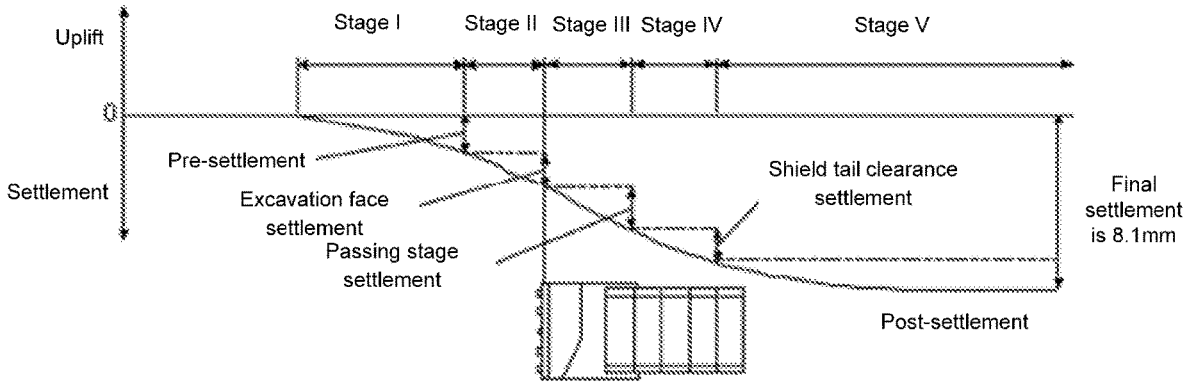
FIG. 3 is a schematic diagram of a whole process curve of stratum settlement of a characteristic section of Hankou section a at a certain time according to an embodiment of the disclosure.
Figure 4:
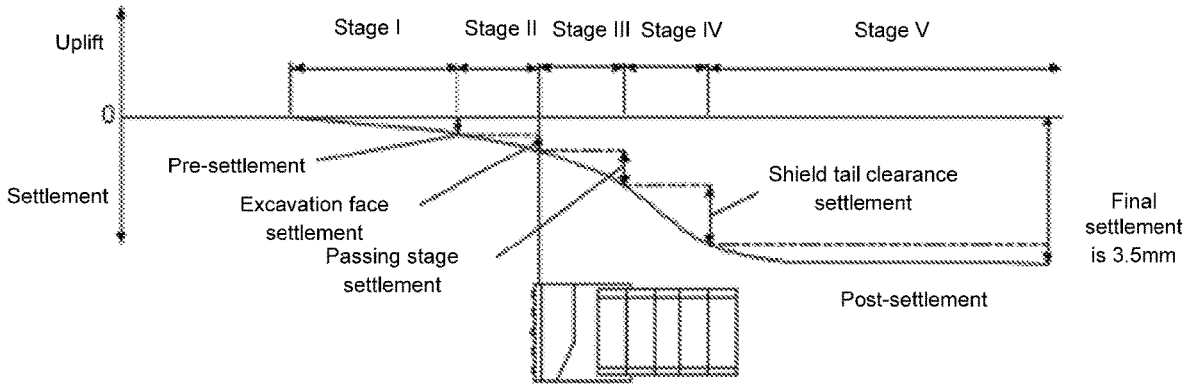
FIG. 4 is a schematic diagram of a whole process curve of stratum settlement of a characteristic section of in-river maximum overburden section b at a certain time according to an embodiment of the disclosure.
Figure 5:
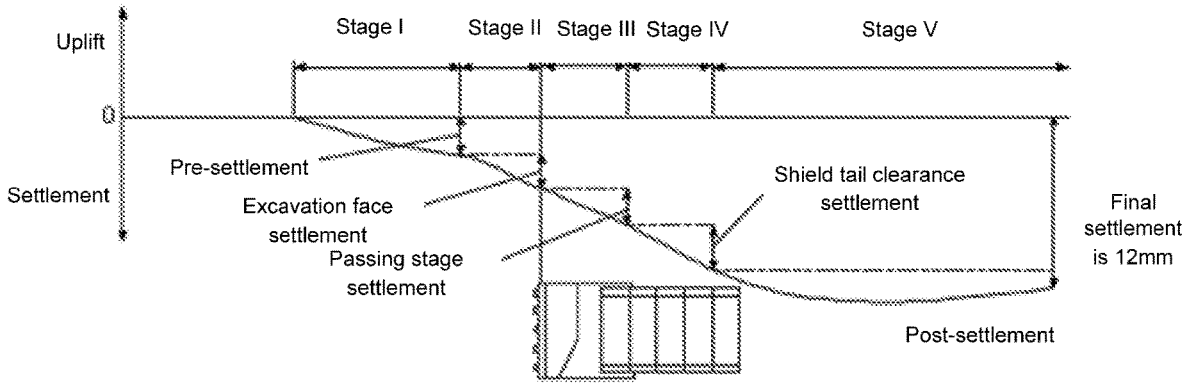
FIG. 5 is a schematic diagram of a whole process curve of stratum settlement of a characteristic section of in-river maximum overburden section c at a certain time according to an embodiment of the disclosure.
Figure 6:
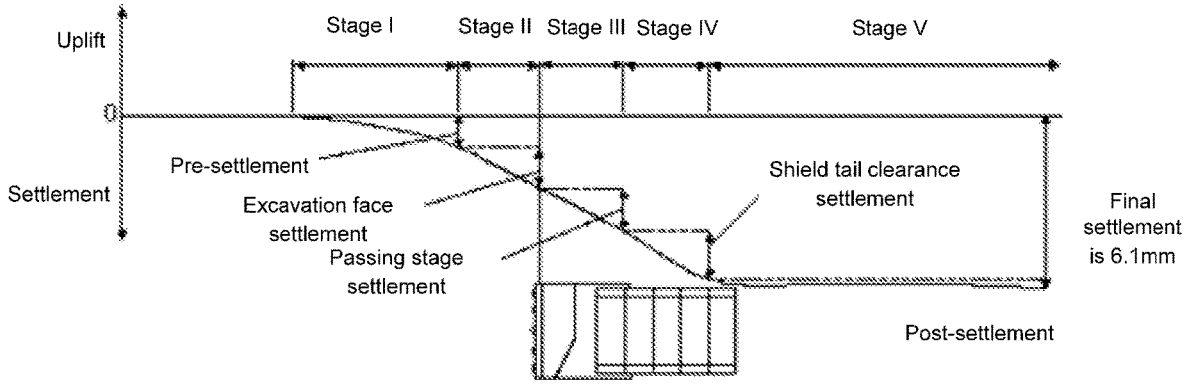
FIG. 6 is a schematic diagram of a whole process curve of stratum settlement of a characteristic section of Wuchang section d at a certain time according to an embodiment of the disclosure.
Figure 7:
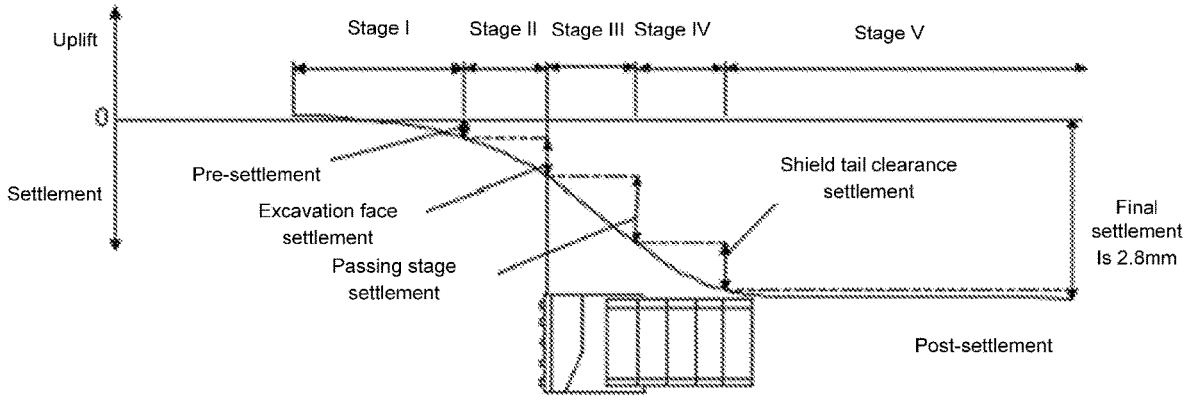
FIG. 7 is a schematic diagram of a whole process curve of stratum settlement of a characteristic section of Wuchang section e at a certain time according to an embodiment of the disclosure.
Figure 8:
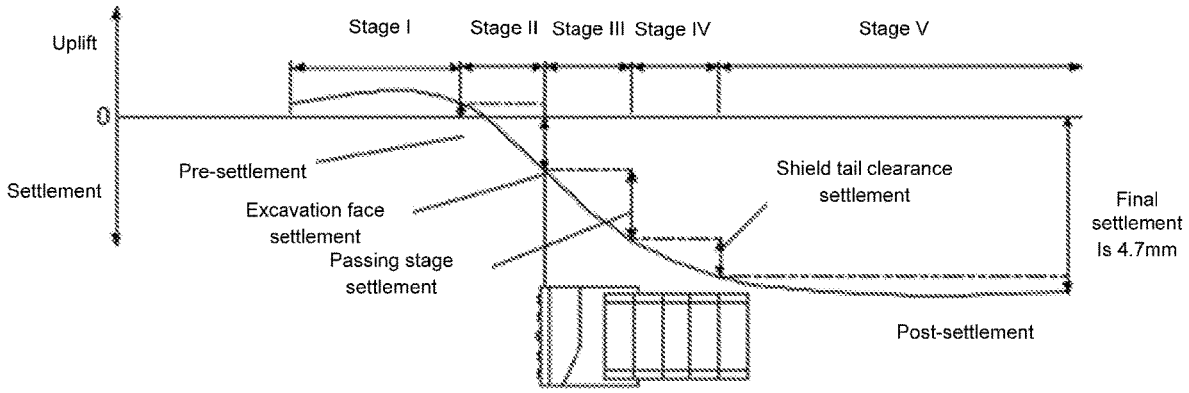
FIG. 8 is a schematic diagram of a whole process curve of stratum settlement of a characteristic section of Wuchang section f at a certain time according to an embodiment of the disclosure.

In an embodiment of the disclosure, as shown in FIG. 2, the stratum deformation process in the shield construction process is divided into five settlement stages, namely a pre-deformation stage, an excavation face deformation stage, a deformation stage in passing process, a shield tail rear deformation stage, and a post-deformation stage. The operation that construction parameters in the shield construction process are determined according to the settlement proportion includes: the construction parameters corresponding to the settlement stages are determined according to a settlement proportion of each settlement stage. Specifically, stages I, II, III, IV, and V of a settlement curve of FIG. 2 correspond to a pre-deformation stage, an excavation face deformation stage, a deformation stage in passing process, a shield tail rear deformation stage, and a post-deformation stage in sequence. The pre-deformation occurs in a region 3-12 m in front of a cutter head, the excavation face deformation occurs in a region between 3 m in front of the cutter head and the cutter head, the passing stage deformation occurs in a region between the cutter head and a shield tail, the shield tail deformation occurs behind the shield tail, and the post-settlement deformation occurs about 100 h after passing through the shield tail, where the front and the rear are relative to a tunneling direction of a shield machine.

It is to be noted that stratum settlement at stage I and II is mainly affected by a front stratum pore water pressure and a supporting force of an excavation face. For slurry shield, the front stratum pore water pressure and an effective supporting pressure of the excavation face are mainly affected by the slurry film-forming quality and the rationality of the supporting force. Therefore, the influence rules of the front stratum pore water pressure and the effective supporting pressure of the excavation face on surface settlement at stages I and II need to be analyzed. Surface settlement at stage III is mainly affected by shield overbreak and shield taper space clearance. Although this clearance is small, it will also lead to large surface settlement in shallow strata, so it is necessary to pay attention to the clearance change here and filling effect of inert filling materials. Surface settlement at stage IV is mainly affected by synchronous grouting filling of a shield tail clearance, synchronous grout is injected into the shield tail clearance at the shield tail, a clearance between a lining segment and a soil body is filled, and the filling and reinforcing effects are achieved. Stage V is mainly affected by the re-consolidation of the strata and the soil body, the shield gradually tends to be stable after passing through the tunnel, and the disturbed stratum gradually reaches new stability. For an underground water-rich area, a segment floating phenomenon is likely to occur due to the large underground water pressure, and even the surface settlement is reduced.

In an embodiment of the disclosure, the operation that a settlement proportion is predicted according to the settlement characteristic parameters includes: machine training is performed by using multiple training data sets to obtain a settlement prediction model, each training data set including: training settlement characteristic parameters and a training settlement proportion corresponding to each training settlement stage; and the settlement characteristic parameters corresponding to each settlement stage are analyzed by adopting the settlement prediction model, and the settlement proportion corresponding to each settlement stage is predicted. Specifically, the settlement characteristic parameters corresponding to different settlement stages are different, the corresponding settlement proportions are also different, the settlement prediction model is adopted to analyze the settlement characteristic parameters corresponding to each settlement stage, predicted settlement proportions corresponding to each settlement stage are obtained, and shield construction is conveniently guided according to the predicted settlement proportions.

In the actual shield construction process, the stratum deformation and settlement influence factors are formed at each settlement stage, so the corresponding settlement characteristic parameters of each settlement stage are different. In an embodiment of the disclosure, the settlement characteristic parameters corresponding to the pre-deformation stage include a tunnel burial depth, a section size, an underground pore water pressure, and a supporting force, the settlement characteristic parameters corresponding to the excavation face deformation stage include a tunnel burial depth, a section size, an underground water pressure, and a supporting force, the settlement characteristic parameters corresponding to the deformation stage in passing process include a tunnel burial depth, a section size, an underground pore water pressure, and a filling amount of inert filling materials, the settlement characteristic parameters corresponding to the shield tail rear deformation stage include a tunnel burial depth, a section size, an underground water pressure, a elastic modulus of synchronous post-grouting slurry, and a grouting pressure, and the settlement characteristic parameters corresponding to the post-deformation stage include a tunnel burial depth, a section size, an underground water pressure, and mechanical parameters of stratum.

It is to be noted that in the actual project, as shown in FIGS. 3 to 8, according to the analysis of settlement characteristic parameters, a whole process curve of stratum settlement of each characteristic section along the axis direction of a tunnel at a certain moment is obtained. Since the excavation strata and the burial depth of each tunnel are different, the final settlement of each characteristic section in Wuchang section, in-river section and Hankou section and the settlement of each stage are different, and the ratio of the five stages of shield settlement to the total settlement is also different.

In addition, the influences of tunnel burial depth and underground water pressure on stratum deformation and settlement are discussed.

Influence of tunnel burial depth: The characteristic section of Hankou section a and the characteristic section of Wuchang section d belong to sections with a large burial depth, and the variations of the settlement stages are similar, where the surface settlement at the shield tail clearance is the largest, accounting for about 30% to 40% of the total settlement, and also conforms to a common shield tunnel settlement law, and the shield tail needs to be timely applied with synchronous grouting for supporting. By analyzing the surface settlement of two shallow-buried characteristic sections in Wuchang section, the current displacement of f-characteristic section with the shallowest depth shows the phenomenon of surface uplift, and the ratio of surface settlement at a shield passing stage is the largest. Since the tunnel excavation for the surface disturbance is stronger than a deep-buried tunnel when the burial depth is small, the stratum is relatively sensitive, so a shallow-buried tunnel needs to pay attention to the surface settlement or uplift, the construction parameters are adjusted according to the actual situation, and filling of a shield body clearance and filling of a shield tail clearance are strengthened.

Influence of underground water pressure: The characteristic section of in-river maximum overburden b and the section of in-river minimum overburden c belong to sections with a large underground water pressure, and the maximum water pressure reaches 6.74 bar. The characteristic section c has a small burial depth and a large water pressure, and the final settlement reaches 12 mm. In addition, since the water pressure around the tunnel with a small burial depth is large, after the shield tail clearance sinks, the segment may generate upward displacement due to the buoyancy, and even the stratum above the tunnel may generate upward displacement. In view of the tunnel crossing the river, besides strengthening the clearance filling and support, it should pay close attention to the dynamics of the segment, thereby preventing the segment from water leakage caused by the dislocation due to buoyancy, and strengthening the monitoring and measurement at each stage.

Figure 9:
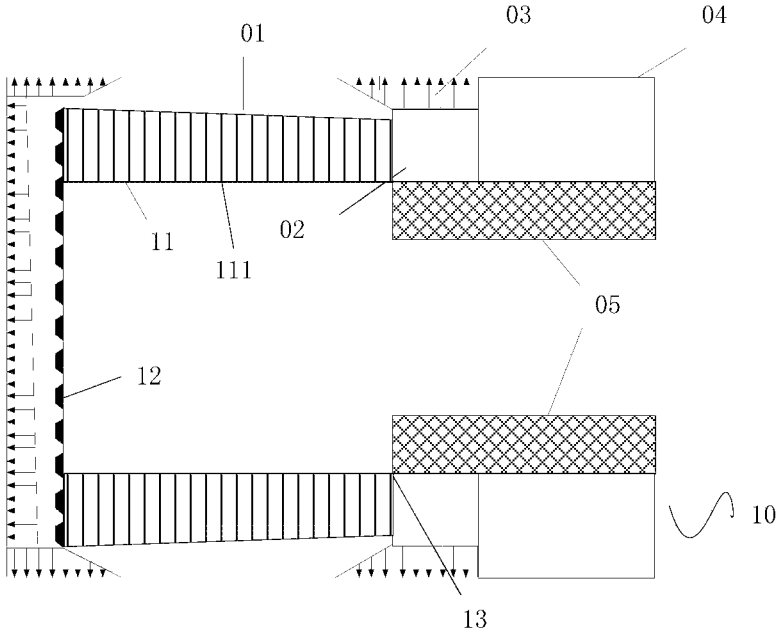
FIG. 9 is a schematic diagram of a shield machine in operation according to an embodiment of the disclosure.

In an embodiment of the disclosure, as shown in FIG. 9, a shield machine 10 includes a shield body 11, a cutter head 12, and a shield tail sealing structure 13. The shield body 11 is provided with radial grouting holes 111, and the shield tail sealing structure 13 is formed by grease and can prevent grout in the shield machine 10 from leaking. In a specific construction process, the cutter head 12 of the shield machine 10 operates to tunnel forwards, the supporting pressure in front of the cutter head is controlled, underpressure is prevented, the shield machine 10 synchronously injects filling materials 01 with a lubricating effect through the radial grouting holes 111 in the shield body 11, and then synchronously grouts a shield body clearance and a shield tail clearance 02, a segment is installed on newly injected grout 03, after the newly injected grout 03 is strengthened, strengthened grout 04 is formed, and the segment forms a lining 05, so that the stability of a soil layer is ensured.

In an embodiment of the disclosure, the operation that the construction parameters corresponding to the settlement stages are determined according to a settlement proportion of each settlement stage includes: it is determined whether the settlement proportion of each settlement stage is within a corresponding predetermined range; and the construction parameters corresponding to the settlement stage are adjusted when the settlement proportion is not within the corresponding predetermined range. Specifically, those skilled in the art can select an appropriate predetermined range for the settlement proportion of each settlement stage according to the actual situation so that the sum of the settlement proportions of each settlement stage is less than or equal to 100%, i.e. it is ensured that the sum of the settlement values of each settlement stage is less than a settlement threshold, and when the settlement proportion is not within the corresponding predetermined range, the settlement proportion corresponding to each settlement stage falls within the corresponding predetermined range by adjusting the construction parameters corresponding to the settlement stages, so that the safety and scientificity of stratum deformation control in shield construction are further ensured.

In an embodiment of the disclosure, the construction parameters corresponding to the pre-deformation stage and the excavation face deformation stage include a slurry pressure, the settlement proportion corresponding to the pre-deformation stage is a first settlement proportion, the settlement proportion corresponding to the excavation face deformation stage is a second settlement proportion, the predetermined ranges corresponding to the pre-deformation stage and the excavation face deformation stage are a first predetermined range, a minimum value of the first predetermined range is a first threshold, and a maximum value of the first predetermined range is a second threshold. The operation that the construction parameters corresponding to target settlement stage are adjusted when the settlement proportion of the target settlement stage is not within the corresponding predetermined range includes: the slurry pressure is reduced when the first settlement proportion and/or the second settlement proportion are smaller than the first threshold; and the slurry pressure is increased when the first settlement proportion and/or the second settlement proportion are greater than the second threshold. Specifically, the pre-deformation stage and the excavation face deformation stage are used as the first and second main settlement stages, and it is necessary to strictly control a slurry pressure to prevent under-pressure. When the first settlement proportion and/or the second settlement proportion are smaller than a first threshold, i.e. the predicted settlement values of the pre-deformation stage and/or the excavation face deformation stage are lower, the slurry pressure can be reduced, and construction materials can be saved. When the first settlement proportion and/or the second settlement proportion are greater than a second threshold, i.e. the predicted settlement values of the pre-deformation stage and/or the excavation face deformation stage are higher, the slurry pressure can be increased, and the stratum deformation settlement at the pre-deformation stage and/or the excavation face deformation stage can be relieved. In addition, in the actual construction process, an actual cement pressure is slightly larger than a calculated value, parameters are timely adjusted and corrected through information construction, and the slurry pressure is within a first predetermined range, so that the safety and scientificity of stratum deformation control in shield construction are further ensured.

In an embodiment of the disclosure, the slurry pressure ranges from $P_w$ to $P_w$+20 kPa, where $P_w$ is a hydrostatic pressure at the location of the pre-deformation stage or the excavation face deformation stage. Specifically, the slurry pressure is set to be within the above range, so that under-pressure can be prevented, and stratum deformation settlement at the pre-deformation stage and/or the excavation face deformation stage can be effectively relieved. In addition, the value range of the above slurry pressure is not limited thereto. Those skilled in the art can select an appropriate value range according to the actual situation.

In an embodiment of the disclosure, the construction parameters corresponding to the deformation stage in passing process include at least one of a fluctuation value of a incision water pressure, a tunneling speed, a cutter head torque, a cutter head rotating speed, and a filling material injection rate, the settlement proportion corresponding to the deformation stage in passing process is a third settlement proportion, the predetermined range corresponding to the deformation stage in passing process is a second predetermined range, a minimum value of the second predetermined range is a third threshold, and a maximum value of the second predetermined range is a fourth threshold. The operation that the construction parameters corresponding to target settlement stage are adjusted when the settlement proportion of the target settlement stage is not within the corresponding predetermined range includes: at least one of the fluctuation value of the incision water pressure, the tunneling speed, the cutter head torque, and the cutter head rotating speed is increased, and/or the filling material injection rate is reduced when the third settlement proportion is smaller than the third threshold; and at least one of the fluctuation value of the incision water pressure, the tunneling speed, the cutter head torque, and the cutter head rotating speed is reduced, and/or the filling material injection rate is increased when the third settlement proportion is greater than the fourth threshold.

Specifically, the deformation stage in passing process is used as the third main settlement stage, it is necessary to pay attention to the surface settlement or uplift at any time, adjust the construction parameters according to the actual situation timely, prevent the shield machine from disturbing the soil too much, strictly control the shield posture, and prevent excessive overbreak. Especially, inert grout with a lubricating effect is synchronously injected into the radial grouting holes in the middle of the shield machine, the clearance between the shield body and the soil body is filled timely to control the stratum settlement deformation of a passing region. By adjusting the fluctuation value of the incision water pressure, the tunneling speed, the cutter head torque, the cutter head rotating speed, and the filling material injection rate, the third settlement proportion falls within a second predetermined range, so that the safety and scientificity of stratum deformation control in shield construction are further ensured.

In an embodiment of the disclosure, the fluctuation value of the incision water pressure ranges from 0 to 10 kpa, the tunneling speed ranges from 15 to 30 mm/min, the cutter head torque ranges from 6 to 9 MNm, the cutter head rotating speed ranges from 0.8 to 1.2 rpm, and the filling material injection rate ranges from 120% to 130%. Specifically, as the fluctuation of the incision water pressure is larger, the disturbance of the front soil body is larger, and the more loss of the front soil body is caused. By setting the fluctuation value of the incision water pressure within the above range, the stability of the soil layer in the construction process is further ensured. As the tunneling speed is higher, the follow-up speed of synchronous grouting is greatly affected, a cavity behind a segment wall is easily caused, and post-settlement is caused. By setting the tunneling speed within the above range, the deformation settlement of the soil layer caused by the construction process can be further relieved. By setting the cutter head torque within the above range, the abrasion of a cutter can be relieved, and the construction safety can be ensured. By setting the cutter head rotating speed within the above range, the large disturbance to the soft soil layer can be avoided, and the deformation settlement of the soil layer caused by the construction process can be further relieved. When the advancing speed is increased and the cone penetration is more than 50, the cutter head rotating speed can be properly increased, but the cutter head rotating speed is generally not more than 1.2 rpm. In the shield construction process, the shield machine injects a filling material outside the shield body, for example, clay shock. By setting the filling material injection rate within the above range, the clearance between an excavation diameter and the shield body of the shield machine can be effectively filled timely, and the deformation settlement of the soil layer caused by the construction process can be further relieved. In addition, the value ranges of the fluctuation value of the incision water pressure, the tunneling speed, the cutter head torque, the cutter head rotating speed, and the filling material injection rate are not limited thereto. Those skilled in the art can select an appropriate value range according to the actual situation.

It is to be noted that in the construction of weak strata, such as sand layer and muddy clay layer, the tunneling speed ranges from 10 to 20 mm/min to prevent the soil layer from collapsing. When the same geological cone penetration is larger, the torque is larger, if the parameters such as the cone penetration and the tunneling speed are unchanged, the torque is gradually and obviously increased, whether the cutter is seriously abraded or not is considered, the abrasion of the cutter directly causes the torque to be obviously increased, and the cutter needs to be checked after the machine is stopped.

In an embodiment of the disclosure, the construction parameters corresponding to the shield tail rear deformation stage include a grouting pressure and/or a grouting amount, the settlement proportion corresponding to the shield tail rear deformation stage is a fourth settlement proportion, the predetermined range corresponding to the shield tail rear deformation stage is a third predetermined range, a minimum value of the third predetermined range is a fifth threshold, and a maximum value of the third predetermined range is a sixth threshold. The operation that the construction parameters corresponding to target settlement stage are adjusted when the settlement proportion of the target settlement stage is not within the corresponding predetermined range includes: the grouting pressure and/or the grouting amount are reduced when the fourth settlement proportion is smaller than the fifth threshold; and the grouting pressure and/or the grouting amount are increased when the fourth settlement proportion is greater than the sixth threshold. Specifically, the shield tail rear deformation stage is used as the fourth main settlement stage, the shield tail needs to be timely and synchronously grouted for supporting, and the fourth settlement proportion falls within a third predetermined range by controlling the grouting pressure and/or the grouting amount, so that the safety and scientificity of stratum deformation control in shield construction are further ensured. In addition, the grouting material includes cement, fly ash, bentonite, sand water reducer, and water. Of course, those skilled in the art can also select other appropriate grouting materials.

In an embodiment of the disclosure, the grouting pressure ranges from Ps+0.85 Ff to Ps+1.25 Ff, and the grouting amount is greater than or equal to 1.3 Vs, where Ps is a predetermined grouting pressure, Ff is a pipeline friction force, and Vs is a predetermined grouting amount. Specifically, the grouting pressure and the grouting amount are respectively set within the above range, so as to ensure the follow-up speed of synchronous grouting and further relieve the deformation settlement of the soil layer caused in the construction process. In addition, the value ranges of the grouting pressure and the grouting amount are not limited thereto. Those skilled in the art can select an appropriate value range according to the actual situation.

In an embodiment of the disclosure, the construction parameters corresponding to the post-deformation stage include a secondary grouting pressure, the settlement proportion corresponding to the post-deformation stage is a fifth settlement proportion, the predetermined range corresponding to the post-deformation stage is a fourth predetermined range, a minimum value of the fourth predetermined range is a seventh threshold, and a maximum value of the predetermined range is an eighth threshold. The operation that the construction parameters corresponding to targe settlement stage are adjusted when the settlement proportion of the target settlement stage is not within the corresponding predetermined range includes: the secondary grouting pressure is reduced when the fifth settlement proportion is smaller than the seventh threshold; and the secondary grouting pressure is increased when the fifth settlement proportion is greater than the eighth threshold. Specifically, the post-deformation stage is used as the fifth main settlement stage, it is necessary to carry out secondary follow-up grouting timely through field monitoring data and radar scanning conditions, namely monitoring a tunnel burial depth, a section size, an underground water pressure, stratum parameters, mechanical parameters, etc., so that the fifth settlement proportion falls within a fourth predetermined range, and the safety and scientificity of stratum deformation control in shield construction are further ensured. In addition, if the settlement proportion is too large, the secondary grouting amount can be increased. Moreover, the secondary grouting material can be water glass+cement mortar double-liquid slurry. Those skilled in the art can select other appropriate grouting materials.

In an embodiment of the disclosure, the secondary grouting pressure ranges from 400 to 600 kpa. Specifically, the secondary grouting pressure is set within the above range, the consolidation effect of the secondary grouting is ensured, and the deformation settlement of the soil layer caused in the construction process can be further relieved. In addition, the value range of the secondary grouting pressure is not limited thereto, and those skilled in the art can select an appropriate value range according to the actual situation.

The embodiment of the disclosure also provides an apparatus for controlling stratum deformation in a shield construction process. It is to be noted that the apparatus for controlling stratum deformation in a shield construction process may be used for performing the method for controlling stratum deformation in a shield construction process provided by the embodiment of the disclosure. The apparatus for controlling stratum deformation in a shield construction process provided by the embodiment of the disclosure is described below.

Figure 10:
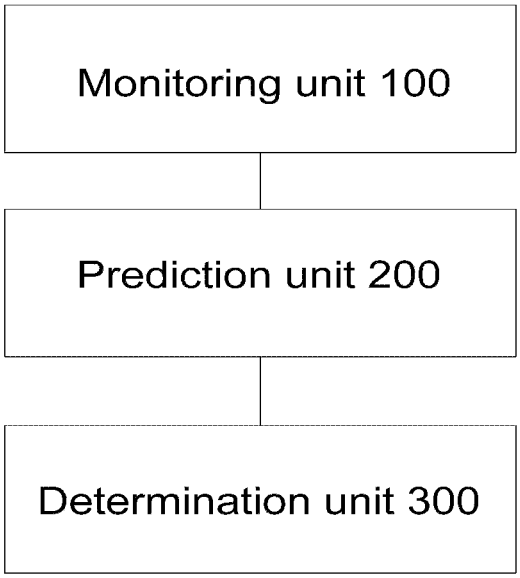
FIG. 10 is a schematic diagram of an apparatus for controlling stratum deformation in a shield construction process according to an embodiment of the disclosure.

FIG. 10 is a schematic diagram of an apparatus for controlling stratum deformation in a shield construction process according to an embodiment of the disclosure. The apparatus includes:

a monitoring unit 100, configured to monitor settlement characteristic parameters of stratum deformation in a shield construction process;

a prediction unit 200, configured to predict a settlement proportion according to the settlement characteristic parameters, the settlement proportion being a ratio between a predicted settlement value and a corresponding settlement threshold; and a determination unit 300, configured to determine construction parameters in the shield construction process according to the settlement proportion.

In the above apparatus, the monitoring unit monitors settlement characteristic parameters in a shield construction process; the prediction unit predicts a settlement proportion according to the settlement characteristic parameters, namely a ratio of a predicted settlement value to a corresponding settlement threshold, where the settlement value is a distance of stratum deformation settlement in the shield construction process, and the settlement threshold is a maximum settlement value for ensuring soil stability; and the determination unit determines construction parameters in the shield construction process according to the settlement proportion. In the apparatus, a settlement proportion is predicted through settlement characteristic parameters monitored in a shield construction process, and then appropriate construction parameters are determined according to the settlement proportion, so that the construction parameters in the shield construction process can be corrected in real time, the safety and scientificity of stratum deformation control in shield construction can be ensured, and the problem in the existing technology that it is difficult to control stratum deformation settlement can be solved.

In an embodiment of the disclosure, as shown in FIG. 2, the stratum deformation process in the shield construction process is divided into five settlement stages, namely a pre-deformation stage, an excavation face deformation stage, a deformation stage in passing process, a shield tail rear deformation stage, and a post-deformation stage. The operation that construction parameters in the shield construction process are determined according to the settlement proportion includes: the construction parameters corresponding to the settlement stages are determined according to a settlement proportion of each settlement stage. Specifically, stages I, II, III, IV, and V of a settlement curve of FIG. 2 correspond to a pre-deformation stage, an excavation face deformation stage, a deformation stage in passing process, a shield tail rear deformation stage, and a post-deformation stage in sequence. The pre-deformation occurs in a region 3-12 m in front of a cutter head, the excavation face deformation occurs in a region between 3 m in front of the cutter head and the cutter head, the passing stage deformation occurs in a region between the cutter head and a shield tail, the shield tail deformation occurs behind the shield tail, and the post-settlement deformation occurs about 100 h after passing through the shield tail, where the front and the rear are relative to a tunneling direction of a shield machine.

It is to be noted that stratum settlement at stage I and II is mainly affected by a front stratum pore water pressure and a supporting force of an excavation face. For slurry shield, the front stratum pore water pressure and an effective supporting pressure of the excavation face are mainly affected by the slurry film-forming quality and the rationality of the supporting force. Therefore, the influence rules of the front stratum pore water pressure and the effective supporting pressure of the excavation face on surface settlement at stages I and II need to be analyzed. Surface settlement at stage III is mainly affected by shield overbreak and shield taper space clearance. Although this clearance is small, it will also lead to large surface settlement in shallow strata, so it is necessary to pay attention to the clearance change here and filling effect of inert filling materials. Surface settlement at stage IV is mainly affected by synchronous grouting filling of a shield tail clearance, synchronous grout is injected into the shield tail clearance at the shield tail, a clearance between a lining segment and a soil body is filled, and the filling and reinforcing effects are achieved. Stage V is mainly affected by the re-consolidation of the strata and the soil body, the shield gradually tends to be stable after passing through the tunnel, and the disturbed stratum gradually reaches new stability. For an underground water-rich area, a segment floating phenomenon is likely to occur due to the large underground water pressure, and even the surface settlement is reduced.

In an embodiment of the disclosure, the prediction unit includes a training module and a prediction module, where the training module is configured to perform machine training by using multiple training data sets to obtain a settlement prediction model, each training data set including: training settlement characteristic parameters and a training settlement proportion corresponding to each training settlement stage; and the prediction module is configured to analyze the settlement characteristic parameters corresponding to each settlement stage by adopting the settlement prediction model, and predict the settlement proportion corresponding to each settlement stage. Specifically, the settlement characteristic parameters corresponding to different settlement stages are different, the corresponding settlement proportions are also different, the settlement prediction model is adopted to analyze the settlement characteristic parameters corresponding to each settlement stage, predicted settlement proportions corresponding to each settlement stage are obtained, and shield construction is conveniently guided according to the predicted settlement proportions.

In the actual shield construction process, the stratum deformation and settlement influence factors are formed at each settlement stage, so the corresponding settlement characteristic parameters of each settlement stage are different. In an embodiment of the disclosure, the settlement characteristic parameters corresponding to the pre-deformation stage include a tunnel burial depth, a section size, an underground pore water pressure, and a supporting force, the settlement characteristic parameters corresponding to the excavation face deformation stage include a tunnel burial depth, a section size, an underground water pressure, and a supporting force, the settlement characteristic parameters corresponding to the deformation stage in passing process include a tunnel burial depth, a section size, an underground pore water pressure, and a filling amount of inert filling materials, the settlement characteristic parameters corresponding to the shield tail rear deformation stage include a tunnel burial depth, a section size, an underground water pressure, a elastic modulus of synchronous post-grouting slurry, and a grouting pressure, and the settlement characteristic parameters corresponding to the post-deformation stage include a tunnel burial depth, a section size, an underground water pressure, and mechanical parameters of stratum.

It is to be noted that in the actual project, as shown in FIGS. 3 to 8, according to the analysis of settlement characteristic parameters, a whole process curve of stratum settlement of each characteristic section along the axis direction of a tunnel at a certain moment is obtained. Since the excavation strata and the burial depth of each tunnel are different, the final settlement of each characteristic section in Wuchang section, in-river section and Hankou section and the settlement of each stage are different, and the ratio of the five stages of shield settlement to the total settlement is also different.

In addition, the influences of tunnel burial depth and underground water pressure on stratum deformation and settlement are discussed.

Influence of tunnel burial depth: The characteristic section of Hankou section a and the characteristic section of Wuchang section d belong to sections with a large burial depth, and the variations of the settlement stages are similar, where the surface settlement at the shield tail clearance is the largest, accounting for about 30% to 40% of the total settlement, and also conforms to a common shield tunnel settlement law, and the shield tail needs to be timely applied with synchronous grouting for supporting. By analyzing the surface settlement of two shallow-buried characteristic sections in Wuchang section, the current displacement of f-characteristic section with the shallowest depth shows the phenomenon of surface uplift, and the ratio of surface settlement at a shield passing stage is the largest. Since the tunnel excavation for the surface disturbance is stronger than a deep-buried tunnel when the burial depth is small, the stratum is relatively sensitive, so a shallow-buried tunnel needs to pay attention to the surface settlement or uplift, the construction parameters are adjusted according to the actual situation, and filling of a shield body clearance and filling of a shield tail clearance are strengthened.

Influence of underground water pressure: The characteristic section of in-river maximum overburden b and the section of in-river minimum overburden c belong to sections with a large underground water pressure, and the maximum water pressure reaches 6.74 bar. The characteristic section c has a small burial depth and a large water pressure, and the final settlement reaches 12 mm. In addition, since the water pressure around the tunnel with a small burial depth is large, after the shield tail clearance sinks, the segment may generate upward displacement due to the buoyancy, and even the stratum above the tunnel may generate upward displacement. In view of the tunnel crossing the river, besides strengthening the clearance filling and support, it should pay close attention to the dynamics of the segment, thereby preventing the segment from water leakage caused by the dislocation due to buoyancy, and strengthening the monitoring and measurement at each stage.

In an embodiment of the disclosure, as shown in FIG. 9, a shield machine 10 includes a shield body 11, a cutter head 12, and a shield tail sealing structure 13. The shield body 11 is provided with radial grouting holes 111, and the shield tail sealing structure 13 is formed by grease and can prevent grout in the shield machine 10 from leaking. In a specific construction process, the cutter head 12 of the shield machine 10 operates to tunnel forwards, the supporting pressure in front of the cutter head is controlled, underpressure is prevented, the shield machine 10 synchronously injects filling materials 01 with a lubricating effect through the radial grouting holes 111 in the shield body 11, and then synchronously grouts a shield body clearance and a shield tail clearance 02, a segment is installed on newly injected grout 03, after the newly injected grout 03 is strengthened, strengthened grout 04 is formed, and the segment forms a lining 05, so that the stability of a soil layer is ensured.

In an embodiment of the disclosure, the determination unit includes a determination module and an adjustment module, where the determination module is configured to determine whether the settlement proportion of each settlement stage is within a corresponding predetermined range; and the adjustment module is configured to adjust the construction parameters corresponding to the settlement stage when the settlement proportion is not within the corresponding predetermined range. Specifically, those skilled in the art can select an appropriate predetermined range for the settlement proportion of each settlement stage according to the actual situation so that the sum of the settlement proportions of each settlement stage is less than or equal to 100%, i.e. it is ensured that the sum of the settlement values of each settlement stage is less than a settlement threshold, and when the settlement proportion is not within the corresponding predetermined range, the settlement proportion corresponding to each settlement stage falls within the corresponding predetermined range by adjusting the construction parameters corresponding to the settlement stages, so that the safety and scientificity of stratum deformation control in shield construction are further ensured.

In an embodiment of the disclosure, the construction parameters corresponding to the pre-deformation stage and the excavation face deformation stage include a slurry pressure, the settlement proportion corresponding to the pre-deformation stage is a first settlement proportion, the settlement proportion corresponding to the excavation face deformation stage is a second settlement proportion, the predetermined ranges corresponding to the pre-deformation stage and the excavation face deformation stage are a first predetermined range, a minimum value of the first predetermined range is a first threshold, and a maximum value of the first predetermined range is a second threshold. The adjustment module includes a first adjustment sub-module and a second adjustment sub-module, where the first adjustment sub-module is configured to reduce the slurry pressure when the first settlement proportion and/or the second settlement proportion are smaller than the first threshold; and the second adjustment sub-module is configured to increase the slurry pressure when the first settlement proportion and/or the second settlement proportion are greater than the second threshold. Specifically, as first and second main settlement stages, the pre-deformation stage and the excavation face deformation stage need to strictly control a slurry pressure to prevent under-pressure. When the first settlement proportion and/or the second settlement proportion are smaller than a first threshold, i.e. the predicted settlement values of the pre-deformation stage and/or the excavation face deformation stage are lower, the slurry pressure can be reduced, and construction materials can be saved. When the first settlement proportion and/or the second settlement proportion are greater than a second threshold, i.e. the predicted settlement values of the pre-deformation stage and/or the excavation face deformation stage are higher, the slurry pressure can be increased, and the stratum deformation settlement at the pre-deformation stage and/or the excavation face deformation stage can be relieved. In addition, in the actual construction process, an actual cement pressure is slightly larger than a calculated value, parameters are timely adjusted and corrected through information construction, and the slurry pressure is within a first predetermined range, so that the safety and scientificity of stratum deformation control in shield construction are further ensured.

In an embodiment of the disclosure, the slurry pressure ranges from $P_W$ to $P_w$+20 kPa, where $P_w$ is a hydrostatic pressure at the location of the pre-deformation stage or the excavation face deformation stage. Specifically, the slurry pressure is set to be within the above range, so that underpressure can be prevented, and stratum deformation settlement at the pre-deformation stage and/or the excavation face deformation stage can be effectively relieved. In addition, the value range of the above slurry pressure is not limited thereto. Those skilled in the art can select an appropriate value range according to the actual situation.

In an embodiment of the disclosure, the construction parameters corresponding to the deformation stage in passing process include at least one of a fluctuation value of a incision water pressure, a tunneling speed, a cutter head torque, a cutter head rotating speed, and a filling material injection rate, the settlement proportion corresponding to the deformation stage in passing process is a third settlement proportion, the predetermined range corresponding to the deformation stage in passing process is a second predetermined range, a minimum value of the second predetermined range is a third threshold, and a maximum value of the second predetermined range is a fourth threshold. The adjustment module includes a third adjustment sub-module and a fourth adjustment sub-module, where the third adjustment sub-module is configured to increase at least one of the fluctuation value of the incision water pressure, the tunneling speed, the cutter head torque, and the cutter head rotating speed, and/or reduce the filling material injection rate when the third settlement proportion is smaller than the third threshold; and the fourth adjustment sub-module is configured to reduce at least one of the fluctuation value of the incision water pressure, the tunneling speed, the cutter head torque, and the cutter head rotating speed, and/or increase the filling material injection rate when the third settlement proportion is greater than the fourth threshold.

Specifically, the deformation stage in passing process is used as the third main settlement stage, it is necessary to pay attention to the surface settlement or uplift at any time, adjust the construction parameters according to the actual situation timely, prevent the shield machine from disturbing the soil too much, strictly control the shield posture, and prevent excessive overbreak. Especially, inert grout with a lubricating effect is synchronously injected into the radial grouting holes in the middle of the shield machine, the clearance between the shield body and the soil body is filled timely to control the stratum settlement deformation of a passing region. By adjusting the fluctuation value of the incision water pressure, the tunneling speed, the cutter head torque, the cutter head rotating speed, and the filling material injection rate, the third settlement proportion falls within a second predetermined range, so that the safety and scientificity of stratum deformation control in shield construction are further ensured.

In an embodiment of the disclosure, the fluctuation value of the incision water pressure ranges from 0 to 10 kpa, the tunneling speed ranges from 15 to 30 mm/min, the cutter head torque ranges from 6 to 9 MNm, the cutter head rotating speed ranges from 0.8 to 1.2 rpm, and the filling material injection rate ranges from 120% to 130%. Specifically, as the fluctuation of the incision water pressure is larger, the disturbance of the front soil body is larger, and the more loss of the front soil body is caused. By setting the fluctuation value of the incision water pressure within the above range, the stability of the soil layer in the construction process is further ensured. As the tunneling speed is higher, the follow-up speed of synchronous grouting is greatly affected, a cavity behind a segment wall is easily caused, and post-settlement is caused. By setting the tunneling speed within the above range, the deformation settlement of the soil layer caused by the construction process can be further relieved. By setting the cutter head torque within the above range, the abrasion of a cutter can be relieved, and the construction safety can be ensured. By setting the cutter head rotating speed within the above range, the large disturbance to the soft soil layer can be avoided, and the deformation settlement of the soil layer caused by the construction process can be further relieved. When the advancing speed is increased and the cone penetration is more than 50, the cutter head rotating speed can be properly increased, but the cutter head rotating speed is generally not more than 1.2 rpm. In the shield construction process, the shield machine injects a filling material outside the shield body, for example, clay shock. By setting the filling material injection rate within the above range, the clearance between an excavation diameter and the shield body of the shield machine can be effectively filled timely, and the deformation settlement of the soil layer caused by the construction process can be further relieved. In addition, the value ranges of the fluctuation value of the incision water pressure, the tunneling speed, the cutter head torque, the cutter head rotating speed, and the filling material injection rate are not limited thereto. Those skilled in the art can select an appropriate value range according to the actual situation.

It is to be noted that in the construction of weak strata, such as sand layer and muddy clay layer, the tunneling speed ranges from 10 to 20 mm/min to prevent the soil layer from collapsing. When the same geological cone penetration is larger, the torque is larger, if the parameters such as the cone penetration and the tunneling speed are unchanged, the torque is gradually and obviously increased, whether the cutter is seriously abraded or not is considered, the abrasion of the cutter directly causes the torque to be obviously increased, and the cutter needs to be checked after the machine is stopped.

In an embodiment of the disclosure, the construction parameters corresponding to the shield tail rear deformation stage include a grouting pressure and/or a grouting amount, the settlement proportion corresponding to the shield tail rear deformation stage is a fourth settlement proportion, the predetermined range corresponding to the shield tail rear deformation stage is a third predetermined range, a minimum value of the third predetermined range is a fifth threshold, and a maximum value of the third predetermined range is a sixth threshold. The adjustment module includes a fifth adjustment sub-module and a sixth adjustment sub-module, where the fifth adjustment sub-module is configured to reduce the grouting pressure and/or the grouting amount when the fourth settlement proportion is smaller than the fifth threshold; and the sixth adjustment sub-module is configured to increase the grouting pressure and/or the grouting amount when the fourth settlement proportion is greater than the sixth threshold. Specifically, the shield tail rear deformation stage is used as the fourth main settlement stage, the shield tail needs to be timely and synchronously grouted for supporting, and the fourth settlement proportion falls within a third predetermined range by controlling the grouting pressure and/or the grouting amount, so that the safety and scientificity of stratum deformation control in shield construction are further ensured. In addition, the grouting material includes cement, fly ash, bentonite, sand water reducer, and water. Of course, those skilled in the art can also select other appropriate grouting materials.

In an embodiment of the disclosure, the grouting pressure ranges from Ps+0.85 Ff to Ps+1.25 Ff, and the grouting amount is greater than or equal to 1.3 Vs, where Ps is a predetermined grouting pressure, Ff is a pipeline friction force, and Vs is a predetermined grouting amount. Specifically, the grouting pressure and the grouting amount are respectively set within the above range, so as to ensure the follow-up speed of synchronous grouting and further relieve the deformation settlement of the soil layer caused in the construction process. In addition, the value ranges of the grouting pressure and the grouting amount are not limited thereto. Those skilled in the art can select an appropriate value range according to the actual situation.

In an embodiment of the disclosure, the construction parameters corresponding to the post-deformation stage include a secondary grouting pressure, the settlement proportion corresponding to the post-deformation stage is a fifth settlement proportion, the predetermined range corresponding to the post-deformation stage is a fourth predetermined range, a minimum value of the fourth predetermined range is a seventh threshold, and a maximum value of the predetermined range is an eighth threshold. The adjustment module includes a seventh adjustment sub-module and an eighth adjustment sub-module, where the seventh adjustment sub-module is configured to reduce the secondary grouting pressure when the fifth settlement proportion is smaller than the seventh threshold; and the eighth adjustment sub-module is configured to increase the secondary grouting pressure when the fifth settlement proportion is greater than the eighth threshold. Specifically, the post-deformation stage is used as the fifth main settlement stage, it is necessary to carry out secondary follow-up grouting timely through field monitoring data and radar scanning conditions, namely monitoring a tunnel burial depth, a section size, an underground water pressure, stratum parameters, mechanical parameters, etc., so that the fifth settlement proportion falls within a fourth predetermined range, and the safety and scientificity of stratum deformation control in shield construction are further ensured. In addition, if the settlement proportion is too large, the secondary grouting amount can be increased. Moreover, the secondary grouting material can be water glass+cement mortar double-liquid slurry. Those skilled in the art can select other appropriate grouting materials.

In an embodiment of the disclosure, the secondary grouting pressure ranges from 400 to 600 kpa. Specifically, the secondary grouting pressure is set within the above range, the consolidation effect of the secondary grouting is ensured, and the deformation settlement of the soil layer caused in the construction process can be further relieved. In addition, the value range of the secondary grouting pressure is not limited thereto, and those skilled in the art can select an appropriate value range according to the actual situation.

The operation and maintenance apparatus includes a processor and a memory. The monitoring unit, the prediction unit and determining unit, etc. are all stored in the memory as program units, and the processor executes the program units stored in the memory to realize corresponding functions.

The processor includes a core, and the core is used for fetching the corresponding program unit from the memory. There may be one or more cores, and the problem in the existing technology that it is difficult to control stratum deformation settlement is solved by adjusting the parameters of the cores.

The memory may include a non-persistent memory, a random access memory (RAM), a non-volatile memory, and/or other forms in a computer-readable medium, such as a read only memory (ROM) or a flash RAM. The memory includes at least one storage chip.

The embodiment of the disclosure provides a non-volatile storage medium. The non-volatile storage medium has a program stored thereon. When executed by a processor, the program implements the above control method.

The embodiment of the disclosure provides a processor. The processor is configured to run a program, where the program, when run, performs the above control method.

The embodiment of the disclosure provides a device, which includes a processor, a memory, and a program stored on the memory and runnable on the processor. When executing the program, the processor implements the following steps.

At step S101, settlement characteristic parameters in a shield construction process are monitored.

At step S102, a settlement proportion is predicted according to the settlement characteristic parameters, the settlement proportion being a ratio between a predicted settlement value and a corresponding settlement threshold.

At step S103, construction parameters in the shield construction process are determined according to the settlement proportion.

The device herein may be a server, a PC, a PAD, a mobile phone, etc.

The disclosure also provides a computer program product that, when executed on a data processing device, is adapted to execute a program initialized with the following method steps.

At step S101, settlement characteristic parameters in a shield construction process are monitored.

At step S102, a settlement proportion is predicted according to the settlement characteristic parameters, the settlement proportion being a ratio between a predicted settlement value and a corresponding settlement threshold.

At step S103, construction parameters in the shield construction process are determined according to the settlement proportion.

Those skilled in the art should understand that the embodiments of the disclosure may be provided as a method, a system, or a computer program product. Therefore, the disclosure may adopt the forms of complete hardware embodiments, complete software embodiments or embodiments integrating software and hardware. Moreover, the disclosure may adopt the form of a computer program product implemented on one or more computer available non-volatile storage media (including, but not limited to, a disk memory, a compact disk-read only memory (CD-ROM), an optical memory and the like) containing computer available program codes.

The disclosure is described with reference to flowcharts and/or block diagrams of the method, the device (system) and the computer program product according to the embodiments of the disclosure. It is to be understood that each flow and/or block in the flowcharts and/or the block diagrams and a combination of the flows and/or the blocks in the flowcharts and/or the block diagrams may be implemented by computer program instructions. These computer program instructions may be provided for a general computer, a dedicated computer, an embedded processor or processors of other programmable data processing equipment to generate a machine, so that an apparatus for achieving functions designated in one or more flows of the flowcharts and/or one or more blocks of the block diagrams is generated via instructions executed by the computers or the processors of the other programmable data processing equipment.

These computer program instructions may also be stored in a computer-readable memory capable of guiding the computers or the other programmable data processing equipment to work in a specific mode, so that a manufactured product including an instruction device is generated via the instructions stored in the computer-readable memory, and the instruction device achieves the functions designated in one or more flows of the flowcharts and/or one or more blocks of the block diagrams.

These computer program instructions may also be loaded to the computers or the other programmable data processing equipment, so that processing implemented by the computers is generated by executing a series of operation steps on the computers or the other programmable equipment, and therefore the instructions executed on the computers or the other programmable equipment provide a step of achieving the functions designated in one or more flows of the flowcharts and/or one or more blocks of the block diagrams.

In a typical configuration, a computing device includes one or more central processing units (CPUs), an input/output interface, a network interface, and a memory.

The memory may include a non-persistent memory, a RAM, a non-volatile memory, and/or other forms in a computer-readable medium, such as a ROM or a flash RAM. The memory is an example of a computer-readable medium.

The computer-readable medium includes non-volatile and volatile, removable and non-removable media. Information may be stored in any way or by any technology. Information may be computer-readable instructions, data structures, modules of programs, or other data. Examples of the non-volatile storage medium of the computer include, but are not limited to, a phase-change random access memory (PRAM), a static random access memory (SRAM), a dynamic random access memory (DRAM), other types of RAMs, a ROM, an electrically erasable programmable read-only memory (EEPROM), a flash memory or other memory technologies, a CD-ROM, a digital versatile disc (DVD) or other optical memories, a cassette tape, a tape and disk memory or other magnetic memories or any other non-transport media. The non-volatile storage medium may be used for storing computing device-accessible information. As defined herein, the computer-readable medium does not include computer-readable transitory media, such as modulated data signals and carrier waves.

Also it should be explained that the terms "include", "contain" or any other variations thereof are intended to cover a non-exclusive inclusion, such that processes, methods, articles or devices including a series of elements not only include those elements, but also include those elements that are not explicitly listed, or include elements inherent to such processes, methods, articles or devices. The elements defined by a statement "include a . . . " shall not exclude the condition that other same elements also exist in the processes, methods, articles or devices including the articles under the condition that no more restraints are required.

From the above description, it can be seen that the above embodiments of the disclosure achieve the following technical effects:

1) In the method of the disclosure, firstly, settlement characteristic parameters in a shield construction process are monitored; then a settlement proportion is predicted according to the settlement characteristic parameters, namely a ratio of a predicted settlement value to a corresponding settlement threshold, where the settlement value is a distance of stratum deformation settlement in the shield construction process, and the settlement threshold is a maximum settlement value for ensuring soil stability; and finally, construction parameters in the shield construction process are determined according to the settlement proportion. In the method, a settlement proportion is predicted through settlement characteristic parameters monitored in a shield construction process, and then appropriate construction parameters are determined according to the settlement proportion, so that the construction parameters in the shield construction process can be corrected in real time, the safety and scientificity of stratum deformation control in shield construction can be ensured, and the problem in the existing technology that it is difficult to control stratum deformation settlement can be solved.

2) In the apparatus of the disclosure, the monitoring unit monitors settlement characteristic parameters in a shield construction process; the prediction unit predicts a settlement proportion according to the settlement characteristic parameters, namely a ratio of a predicted settlement value to a corresponding settlement threshold, where the settlement value is a distance of stratum deformation settlement in the shield construction process, and the settlement threshold is a maximum settlement value for ensuring soil stability; and the determination unit determines construction parameters in the shield construction process according to the settlement proportion. In the apparatus, a settlement proportion is predicted through settlement characteristic parameters monitored in a shield construction process, and then appropriate construction parameters are determined according to the settlement proportion, so that the construction parameters in the shield construction process can be corrected in real time, the safety and scientificity of stratum deformation control in shield construction can be ensured, and the problem in the existing technology that it is difficult to control stratum deformation settlement can be solved.

The above is a preferred implementation of the disclosure. It is to be noted that a number of modifications and refinements may be made by those of ordinary skill in the art without departing from the principles of the disclosure, and such modifications and refinements are also considered to be within the scope of protection of the disclosure.

What claimed is:

1. A method for controlling stratum deformation in a shield construction process, comprising:

monitoring settlement characteristic parameters in a shield construction process;

predicting a settlement proportion according to the settlement characteristic parameters, the settlement proportion being a ratio between a predicted settlement value and a corresponding settlement threshold; and determining construction parameters in the shield construction process according to the settlement proportion;

wherein the stratum deformation process in the shield construction process is divided into five settlement stages, namely a pre-deformation stage, an excavation face deformation stage, a deformation stage in passing process, a shield tail rear deformation stage, and a post-deformation stage; and determining construction parameters in the shield construction process according to the settlement proportion comprises: determining the construction parameters corresponding to the settlement stages according to a settlement proportion of each settlement stage;

wherein determining the construction parameters corresponding to the settlement stages according to a settlement proportion of each settlement stage comprises:

determining whether the settlement proportion of each settlement stage is within a corresponding predetermined range; and adjusting the construction parameters corresponding to target settlement stage when the settlement proportion of the target settlement stage is not within the corresponding predetermined range;

wherein the construction parameters corresponding to the pre-deformation stage and the excavation face deformation stage comprise a slurry pressure, the settlement proportion corresponding to the pre-deformation stage is a first settlement proportion, the settlement proportion corresponding to the excavation face deformation stage is a second settlement proportion, the predetermined ranges corresponding to the pre-deformation stage and the excavation face deformation stage are a first predetermined range, a minimum value of the first predetermined range is a first threshold, and a maximum value of the first predetermined range is a second threshold; and adjusting the construction parameters corresponding to target settlement stage when the settlement proportion of the target settlement stage is not within the corresponding predetermined range comprises: reducing the slurry pressure when the first settlement proportion and/or the second settlement proportion are smaller than the first threshold; and increasing the slurry pressure when the first settlement proportion and/or the second settlement proportion are greater than the second threshold.

2. The method according to claim 1, wherein predicting a settlement proportion according to the settlement characteristic parameters comprises:

performing machine training by using a plurality of training data sets to obtain a settlement prediction model, each training data set comprising: training settlement characteristic parameters and a training settlement proportion corresponding to each training settlement stage; and analyzing the settlement characteristic parameters corresponding to each settlement stage by adopting the settlement prediction model, and predicting the settlement proportion corresponding to each settlement stage.

3. The method according to claim 1, wherein the settlement characteristic parameters corresponding to the pre-deformation stage comprise a tunnel burial depth, a section size, an underground pore water pressure, and a supporting force, the settlement characteristic parameters corresponding to the excavation face deformation stage comprise a tunnel burial depth, a section size, an underground water pressure, and a supporting force, the settlement characteristic parameters corresponding to the deformation stage in passing process comprise a tunnel burial depth, a section size, an underground pore water pressure, and a filling amount of inert filling materials, the settlement characteristic parameters corresponding to the shield tail rear deformation stage comprise a tunnel burial depth, a section size, an underground water pressure, a elastic modulus of elastic modulus of synchronous post-grouting slurry, and a grouting pressure, and the settlement characteristic parameters corresponding to the post-deformation stage comprise a tunnel burial depth, a section size, an underground water pressure, and mechanical parameters of stratum.

4. The method according to claim 1, wherein the slurry pressure ranges from Pw to Pw+20 kpa, where Pw is a hydrostatic pressure at the location of the pre-deformation stage or the excavation face deformation stage.

5. The method according to claim 1, wherein the construction parameters corresponding to the deformation stage in passing process comprise at least one of a fluctuation value of a incision water pressure, a tunneling speed, a cutter head torque, a cutter head rotating speed, and a filling material injection rate, the settlement proportion corresponding to the deformation stage in passing process is a third settlement proportion, the predetermined range corresponding to the deformation stage in passing process is a second predetermined range, a minimum value of the second predetermined range is a third threshold, and a maximum value of the second predetermined range is a fourth threshold; and adjusting the construction parameters corresponding to target settlement stage when the settlement proportion of the target settlement stage is not within the corresponding predetermined range comprises:

increasing at least one of the fluctuation value of the incision water pressure, the tunneling speed, the cutter head torque, and the cutter head rotating speed, and/or reducing the filling material injection rate when the third settlement proportion is smaller than the third threshold; and reducing at least one of the fluctuation value of the incision water pressure, the tunneling speed, the cutter head torque, and the cutter head rotating speed, and/or increasing the filling material injection rate when the third settlement proportion is greater than the fourth threshold.

6. The method according to claim 5, wherein the fluctuation value of the incision water pressure ranges from 0 to 10 kpa, the tunneling speed ranges from 15 to 30 mm/min, the cutter head torque ranges from 6 to 9 MNm, the cutter head rotating speed ranges from 0.8 to 1.2 rpm, and the filling material injection rate ranges from 120% to 130%.

7. He method according to claim 1, wherein the construction parameters corresponding to the shield tail rear deformation stage comprise a grouting pressure and/or a grouting amount, the settlement proportion corresponding to the shield tail rear deformation stage is a fourth settlement proportion, the predetermined range corresponding to the shield tail rear deformation stage is a third predetermined range, a minimum value of the third predetermined range is a fifth threshold, and a maximum value of the third predetermined range is a sixth threshold; and adjusting the construction parameters corresponding to target settlement stage when the settlement proportion of the target settlement stage is not within the corresponding predetermined range comprises:

reducing the grouting pressure and/or the grouting amount when the fourth settlement proportion is smaller than the fifth threshold; and increasing the grouting pressure and/or the grouting amount when the fourth settlement proportion is greater than the sixth threshold.

8. He method according to claim 7, wherein the grouting pressure ranges from Ps+0.85 Ff to Ps+1.25 Ff, and the grouting amount is greater than or equal to 1.3 Vs, where Ps is a predetermined grouting pressure, Ff is a pipeline friction force, and Vs is a predetermined grouting amount.

9. He method according to claim 1, wherein the construction parameters corresponding to the post-deformation stage comprise a secondary grouting pressure, the settlement proportion corresponding to the post-deformation stage is a fifth settlement proportion, the predetermined range corresponding to the post-deformation stage is a fourth predetermined range, a minimum value of the fourth predetermined range is a seventh threshold, and a maximum value of the predetermined range is an eighth threshold; and adjusting the construction parameters corresponding to target settlement stage when the settlement proportion of the target settlement stage is not within the corresponding predetermined range comprises:

reducing the secondary grouting pressure when the fifth settlement proportion is smaller than the seventh threshold; and increasing the secondary grouting pressure when the fifth settlement proportion is greater than the eighth threshold.

10. He method according to claim 9, wherein the secondary grouting pressure ranges from 400 to 600 kpa.

11. A non-volatile storage medium, comprising a stored program, wherein when the program is run, a device where the non-volatile storage medium is located is controlled to perform the control method according to claim 1.

12. The non-volatile storage medium according to claim 11, comprising a stored program, wherein the stratum deformation process in the shield construction process is divided into five settlement stages, namely a pre-deformation stage, an excavation face deformation stage, a deformation stage in passing process, a shield tail rear deformation stage, and a post-deformation stage; and determining construction parameters in the shield construction process according to the settlement proportion comprises: determining the construction parameters corresponding to the settlement stages according to a settlement proportion of each settlement stage.

13. The non-volatile storage medium according to claim 11, comprising a stored program, wherein predicting a settlement proportion according to the settlement characteristic parameters comprises: performing machine training by using a plurality of training data sets to obtain a settlement prediction model, each training data set comprising: training settlement characteristic parameters and a training settlement proportion corresponding to each training settlement stage; and analyzing the settlement characteristic parameters corresponding to each settlement stage by adopting the settlement prediction model, and predicting the settlement proportion corresponding to each settlement stage.

* * * * *